US006408768B1

(12) United States Patent
Giampavolo et al.

(10) Patent No.: US 6,408,768 B1
(45) Date of Patent: Jun. 25, 2002

(54) ADJUSTABLE PALLET GUARD

(75) Inventors: Paul Giampavolo, Somersworth, NH (US); Robert N. Shelton, Princeton, MA (US)

(73) Assignee: Safe Strap Company, Inc., NH (US)

( * ) Notice: Subject to any disclaimer, the term of this patent is extended or adjusted under 35 U.S.C. 154(b) by 0 days.

(21) Appl. No.: 09/537,326

(22) Filed: Mar. 29, 2000

Related U.S. Application Data

(60) Provisional application No. 60/136,168, filed on May 27, 1999.

(51) Int. Cl.[7] ..... A47B 17/00

(52) U.S. Cl. ..... 108/27; 108/51.11; 40/584; 74/608; 74/609; 74/612

(58) Field of Search ..... 108/27, 51.11, 108/55.1, 56.1; 206/386, 459.5, 600; 220/23.88, 23.91; 40/584, 299.01, 784, 78.3; 74/609, 608, 612

(56) References Cited

U.S. PATENT DOCUMENTS

| | | | | |
|---|---|---|---|---|
| 1,256,179 A | * | 2/1918 | Smith | 74/609 |
| 1,918,634 A | | 7/1933 | Cordes | |
| 2,420,640 A | | 5/1947 | Acteson | |
| 2,491,035 A | * | 12/1949 | Deacon | 74/609 |
| 2,762,551 A | | 9/1956 | Fallert | |
| 3,181,176 A | | 5/1965 | Nagy et al. | |
| 3,473,654 A | | 10/1969 | Zimmerman | |
| 3,480,196 A | | 11/1969 | Simas | |
| 3,629,960 A | * | 12/1971 | Roush | 108/27 |
| 3,664,570 A | | 5/1972 | Kupersmit | |
| 3,832,956 A | | 9/1974 | Briel, Jr. | |
| 3,904,066 A | | 9/1975 | Wilson | |
| 4,019,635 A | * | 4/1977 | Boots | 108/55.1 X |
| 4,069,938 A | | 1/1978 | Palte et al. | |
| 4,153,161 A | | 5/1979 | Taylor et al. | |
| 4,292,899 A | | 10/1981 | Steffen | |
| 4,383,609 A | | 5/1983 | Lochmiller | |
| 4,426,015 A | | 1/1984 | Preston et al. | |
| 4,609,116 A | | 9/1986 | Simms | |
| 4,635,562 A | | 1/1987 | Kreeger | |
| 4,715,294 A | | 12/1987 | Depew | |
| 4,738,039 A | * | 4/1988 | Sun et al. | 40/784 |
| 4,834,254 A | | 5/1989 | Mead | |
| 4,838,418 A | | 6/1989 | Teixeira | |
| 4,877,137 A | * | 10/1989 | Govang et al. | 108/55.1 X |
| 5,000,372 A | | 3/1991 | Hollander et al. | |
| 5,037,027 A | | 8/1991 | Nichols | |
| 5,076,175 A | | 12/1991 | Watley, II | |
| 5,180,134 A | | 1/1993 | Mallak | |
| 5,249,699 A | | 10/1993 | Williams | |
| 5,383,408 A | | 1/1995 | Searcy | |
| 5,496,609 A | | 3/1996 | Michelstein | |
| 5,524,383 A | | 6/1996 | Sanko et al. | |
| 5,549,202 A | | 8/1996 | Whiteside | |
| 5,597,084 A | * | 1/1997 | Parasin | 206/600 X |

(List continued on next page.)

FOREIGN PATENT DOCUMENTS

| | | |
|---|---|---|
| DE | 3618357 | 10/1987 |
| GB | 762007 | 11/1956 |
| JP | 3143612 | 6/1991 |

*Primary Examiner*—Peter M. Cuomo
*Assistant Examiner*—Hanh V. Tran
(74) *Attorney, Agent, or Firm*—Ostrolenk, Faber, Gerb & Soffen LLP

(57) ABSTRACT

A pallet guard includes a plurality of modular pallet guard sections. Each pallet guard section comprises a connecting piece and a wall. The connecting pieces are adjustable. The walls are matable with another pallet guard section so that the pallet guard is adjustable to accommodate varying size pallets and/or spill-over merchandise on the pallet. Each connecting piece may be moveable between a first position, wherein the connecting piece is straight, and a second angled position where the pallet connecting piece forms a corner.

35 Claims, 12 Drawing Sheets

U.S. PATENT DOCUMENTS

| | | | | | |
|---|---|---|---|---|---|
| 5,609,111 | A | | 3/1997 | Hasegawa et al. | |
| 5,613,447 | A | | 3/1997 | Trickett | |
| 5,673,629 | A | | 10/1997 | Ginnow | |
| 5,704,488 | A | | 1/1998 | Smith | |
| 5,762,222 | A | | 6/1998 | Liu | |
| 5,899,337 | A | | 5/1999 | Thebeault | |
| 5,909,808 | A | | 6/1999 | Batholomew | |
| 5,972,464 | A | | 10/1999 | Pezzuco | |
| 6,035,790 | A | * | 3/2000 | Polando | 108/55.1 |
| 6,050,419 | A | | 4/2000 | Flanagan et al. | |
| 6,079,560 | A | | 6/2000 | Champion | |
| 6,105,511 | A | * | 8/2000 | Bridges | 108/55.1 X |
| 6,192,807 | B1 | | 2/2001 | Mason | |

* cited by examiner

ADJUSTABLE PALLET GUARD

CROSS-REFERENCE RELATED APPLICATIONS

This application claims priority to and incorporates by reference provisional application No. 60/136,168 filed May 27, 1999.

BACKGROUND OF THE INVENTION

The invention relates to a pallet guard and more particularly to an adjustable, modular pallet guard which can be easily installed and assembled.

Palletized goods are commonly displayed for sale to customers of a business establishment. Displaying goods for sale in this manner is a convenience for business establishment owners or operators as a large quantity of merchandise can easily be transported out of a stock area utilizing a pallet jack or fork lift and placed with discretion around a store without further handling or arranging of the merchandise. While this type of product merchandising is a convenience to store operators, it sometimes creates an unpleasant visual effect and poses dangers to its customers.

Pallets are customarily designed to receive two parallel spaced arms of a pallet jack or fork lift. These arms slip under a pallet having merchandise stacked or placed thereon. The average pallet design is about 5–6 inches from the floor surface on which the pallet rests so that the pallet can receive the arms of the jack. Pallets are often made of wood, although plastic pallets are also available. When merchandise is stored on a pallet, where the pallet is utilized as a platform to display merchandise, initially, only the sides (usually 5–6 inches high) of the pallet may be visible to customers. However, these pallets are generally dirty, often have splintered and sharp edges, and may protrude out under the merchandise causing a danger for customers to trip and fall. As customers remove merchandise from the pallet for purchase, the outer perimeter of the merchandise, starting from the top, is removed first as this merchandise is closer to the customer and more within the customer's reach. Remaining, unsold merchandise is left in the middle of the pallet leaving more of the outer edges of the pallet protruding into the walk path of a customer creating more of a hazard to trip and fall. Customers traversing a store frequently have a shopping cart or some other carrying means for transporting a desired item from its storage place to a check-out counter. Merchandise which is stored on a pallet can be easily damaged by these shopping carts coming in contact with the merchandise or the pallets can injure customers or damage other merchandise or carts. Further, the pallets and/or merchandise can be damaged by these shopping carts.

Although pallets themselves have a standard size, it is convenient for the size of a pallet guard to be adjustable. This is because merchandise stored on a pallet frequently extends beyond the footprint defined by the pallet. If a pallet guard is designed to merely encompass the pallet only, it will be difficult to install the pallet guard if the merchandise spills over the pallet. Further it will not be possible to install the pallet guard to non-standard pallets. Further, the pallet guard could not also protect merchandise that extends beyond the pallet. Additionally, it may be desirable to protect a plurality of pallets which are disposed adjacent to one another or even disposed in an array. For example, similar or identical or even different goods may be placed on multiple adjacent pallets and so it would be logical and aesthetically pleasing to provide a single guard for a plurality of pallets holding these goods.

Prior art devices, like that shown in U.S. Pat. No. 5,704,488, merely provide a temporary barrier for goods stored on a pallet when the pallet is being shipped from one location to another. This barrier is fixed in size and so cannot protect multiple pallets nor can it protect an irregularly shaped pallet or a pallet which has merchandise extending over the footprint of the pallet.

Thus, there exists a need in the art for a pallet guard. Such a pallet guard should be modular to provide protection for multiple pallets and adjustable to provide protection for an irregular shaped pallet or pallet with merchandise extending beyond the pallet's footprint.

SUMMARY OF THE INVENTION

A first aspect of the invention is a pallet guard including a plurality of pallet guard sections. Each pallet guard section comprises an insertion member; and a receiving member coupled to the insertion member. One of the insertion member and the receiving member provides a plurality of adjustable positions for the insertion member with respect to the receiving member so that a respective insertion member of a first pallet guard section and a respective receiving member of a second pallet guard section are engageable in a plurality of positions thereby defining a plurality of areas for the pallet guard.

In a distinctive feature of the first aspect, one of the insertion member and the receiving member is a wall portion and the other of the insertion member and the receiving member is a connecting piece.

In another distinctive feature of the first aspect, the connecting piece comprises a first corner portion and a second corner portion hingedly coupled to the first corner portion. The first and second corner portions are moveable among a plurality of positions with respect to one another including a substantially straight position where the first and second corner portions are substantially in line with respect to one another, and a position in which the two portions are disposed at an angle to one another.

Another aspect of the invention is a method of assembling a pallet guard. The method comprising the acts of coupling together a plurality of pallet guard sections and adjusting the size of the pallet guard.

Yet another aspect of the invention is a pallet guard including a plurality of pallet guard sections. Each pallet guard section comprises a wall portion and a connecting piece, the connecting piece including a first corner portion coupled to a second corner portion. The first and second corner portions are movable among a plurality of positions with respect to one another including a straight position where the first and second corner portions are substantially straight with respect to each other, and a position in which the two portions are disposed at an angle to one another.

Still yet another aspect of the invention is a modular pallet guard comprising a plurality of pallet guard sections coupled together wherein a first quantity of the pallet guard sections coupled together protects a single pallet and a second quantity of the pallet guard sections coupled together protects multiple pallets.

Another aspect of the invention is a combination of a pallet and pallet guard. The combination comprises a pallet guard extending around and protecting the pallet.

Yet another aspect of the invention is a pallet guard comprising a plurality of modular wall sections, the plurality of wall sections being coupleable together by connecting members, the wall sections having a height sufficient to guard at least edge portions of a pallet, the wall sections being coupleable together by the connecting members so that one pallet or a plurality of adjacent pallets can be protected by the pallet guard. Preferably, the pallet guard is adjustable so that if merchandise extends beyond the pallet, the pallet guard is adjustable to account for such a situation.

The above aspects, and other aspects of the invention, will become apparent upon review of the following disclosure and corresponding drawings.

BRIEF DESCRIPTION OF THE DRAWINGS

For the purpose of illustrating the invention there is shown in the drawings form which are presently preferred, it being understood, however, that the invention is not limited to the precise arrangements and instrumentalities shown.

DETAILED DESCRIPTION OF THE PREFERRED EMBODIMENTS

Figure 1:
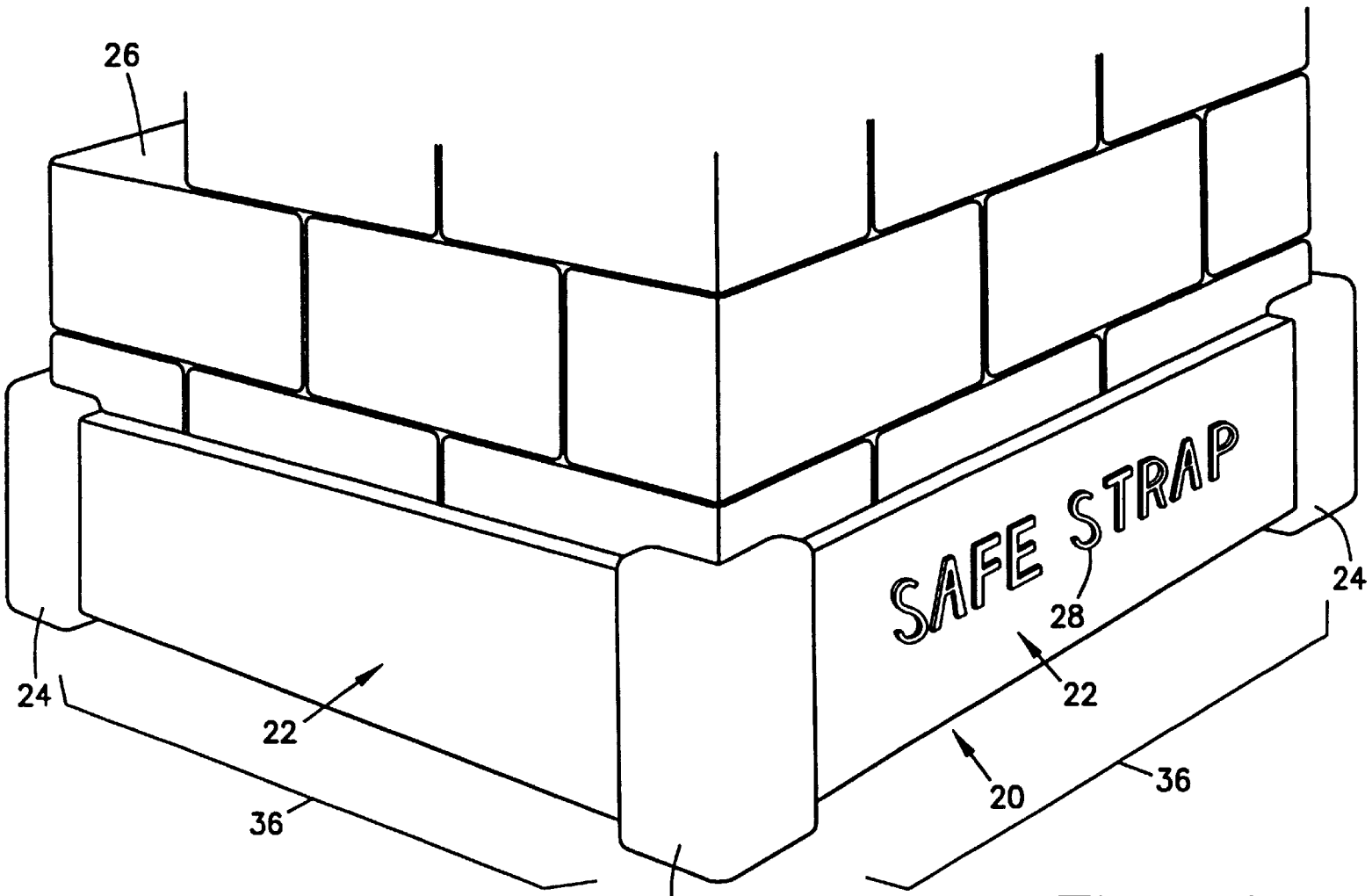
FIG. 1 is a perspective view of a first embodiment of a pallet guard in accordance with the invention.

The present invention provides for a safety guard to be installed around a pallet storing merchandise. Referring to FIG. 1, there is shown a first embodiment of a pallet guard 20 in accordance with the invention. Pallet guard 20 is comprised of a plurality of substantially identical, modular pallet guard sections 36. Each pallet guard section 36 includes a wall section 22 coupled to one corner piece 24. Wall sections 22 extend substantially vertically and perpendicularly from the floor and are preferably at least twice the height of a pallet (not explicitly shown but hidden behind the pallet guard) that pallet guard 20 is to protect. Pallet guard 20 also protects merchandise 26 stacked on the pallet and provides a smooth solid surface that protects customers from tripping and falling over the exposed pallet edges. Pallet guard 20 is preferably made of a molded extruded or blown plastic and may be manufactured in a variety of colors and can include advertising space 28 for messaging, such as sale information, on, for example, one of wall portions 22. Although pallet guard 20 is preferably a plastic, it can be made of any other suitable material.

Figure 2:
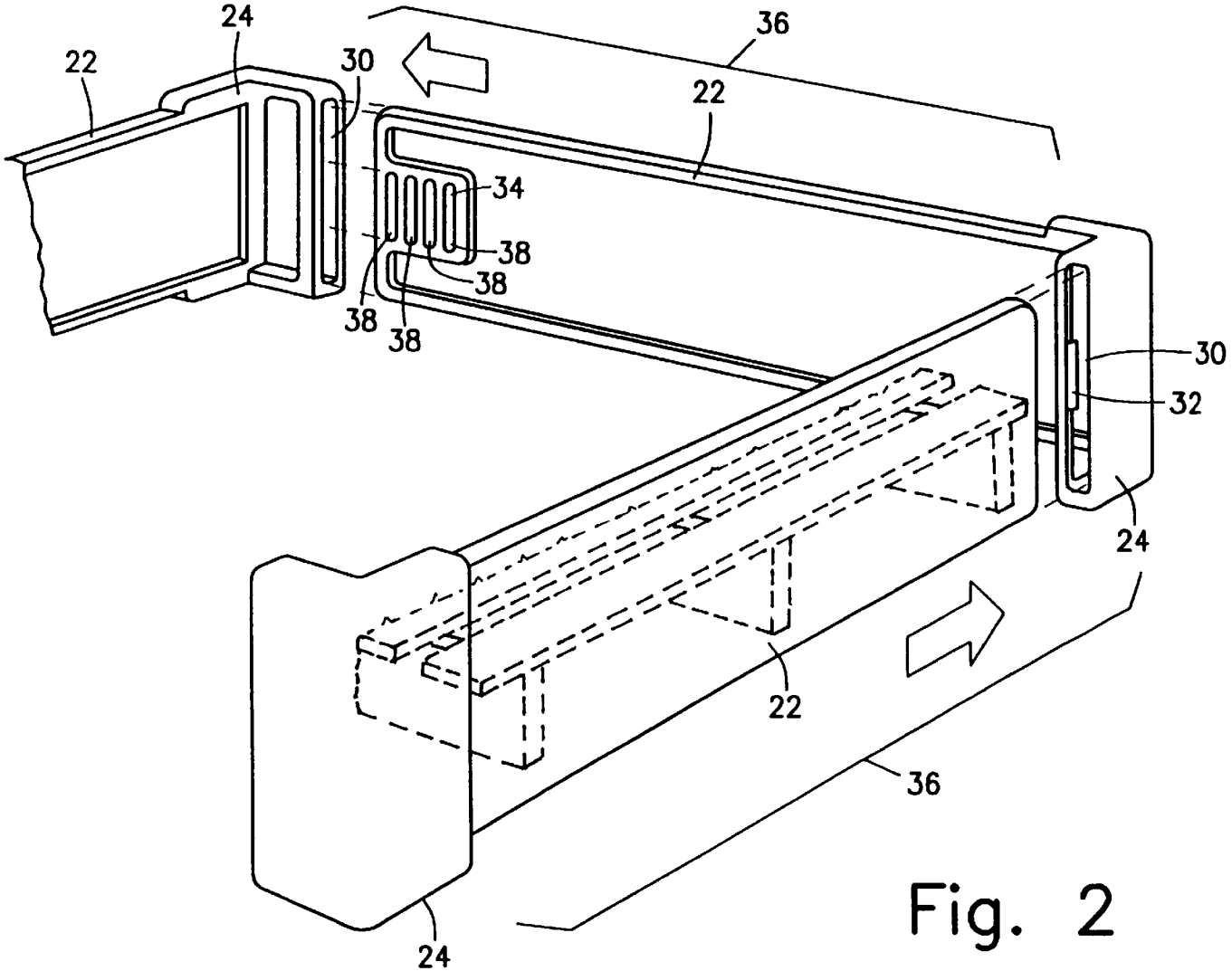
FIG. 2 is a perspective exploded view of the pallet guard of the first embodiment.

Pallet guard 20 can be simply assembled and arranged in various configurations to shield a pallet on at least one side or all sides. Referring now to FIG. 2, there is shown the method for assembling pallet guard 20. Each corner piece 24 of pallet guard section 36 includes a cavity 30 extending. Cavity 30 is designed to receive a wall section 22 of another pallet guard section. Disposed within cavities 30 are detent tabs 32 extending from a wall defining cavity 30, inwardly into a respective cavity 30. Each wall section 22 includes a recess tab 34 having a plurality of recesses 38 therein. When a wall section 22 of a first pallet guard section 36 is inserted within a corresponding corner section of a second pallet guard section 36, detent tab 32 of the corner section is received within a selected recess 38 thereby retaining the wall section in a selected position in the corner section. A plurality of recesses 38 are provided on recess arrangement 34 so that a side wall 22 can be adjusted within a corner piece 24 and thereby define a plurality of lengths of a side of pallet guard 20. Thus, pallet guard 20 is available in a plurality of sizes and so can fit different sized pallets, a plurality of pallets, an irregularly shaped pallet, or a standard pallet which has merchandise extending farther than the footprint of the pallet. This variability is due to the adjustment provided by the sliding arrangement of wall 22 in corner piece 24 into fixed, discrete positions provided by engagement of detent tabs 32 with one of recesses 38. Although the embodiments shows detent tabs 32 and recess arrangement 34, these can be dispensed with, in which case, continuous, limited adjustment is provided merely by the sliding arrangement of wall 22 in corner piece 24.

As stated above, pallet guard 20 is preferably comprised of a plurality of pallet guard sections 36. In the example shown in FIG. 2, four pallet guard sections 36 are connected together in a square rectangle to produce pallet guard 20. Each pallet guard section 36 includes a corner piece 24 integral with a corresponding wall section 22. Clearly, corner sections 24 and wall sections 22 need not be integrally formed into pallet guard sections 36 as corner pieces 24 and wall sections 22 can be formed as separate pieces.

To disassemble pallet guard 20, the appropriate detent tab 32 is simply pulled toward a corresponding wall section 22 thereby disengaging detent tab 32 from a recess 38. A first pallet guard section 36 can now be disengaged from a second pallet guard section 36. To allow for this functionality, corner pieces 24 must be long enough to provide sufficient distance between a wall section 22 and merchandise 26 or a pallet, so that a user's finger can be inserted therein to depress recess tab 36.

Though corner pieces 24 are shown with a generally L-shaped cross-section, other configurations of corner pieces 24 are possible and can be used for different arrangements of pallets. For example, corner pieces 24 can have a T-shaped cross-section so that each corner piece has three cavities to receive three wall sections 22 including a wall section belonging to an adjacent pallet guard. Further, pallets can be arranged in an array and still benefit from the pallet guard of the invention. Corner pieces 24 may also have a cross-shaped cross section with four cavities so that corner pieces 24 can receive four wall sections. Further connecting pieces comprising straight pieces (instead of corner pieces) can be provided so that pallet guards can be arranged modularly in an array, for example, to protect a plurality of pallets arranged in a row. This will be clearer from a review of the second embodiment as described below.

Figure 3:
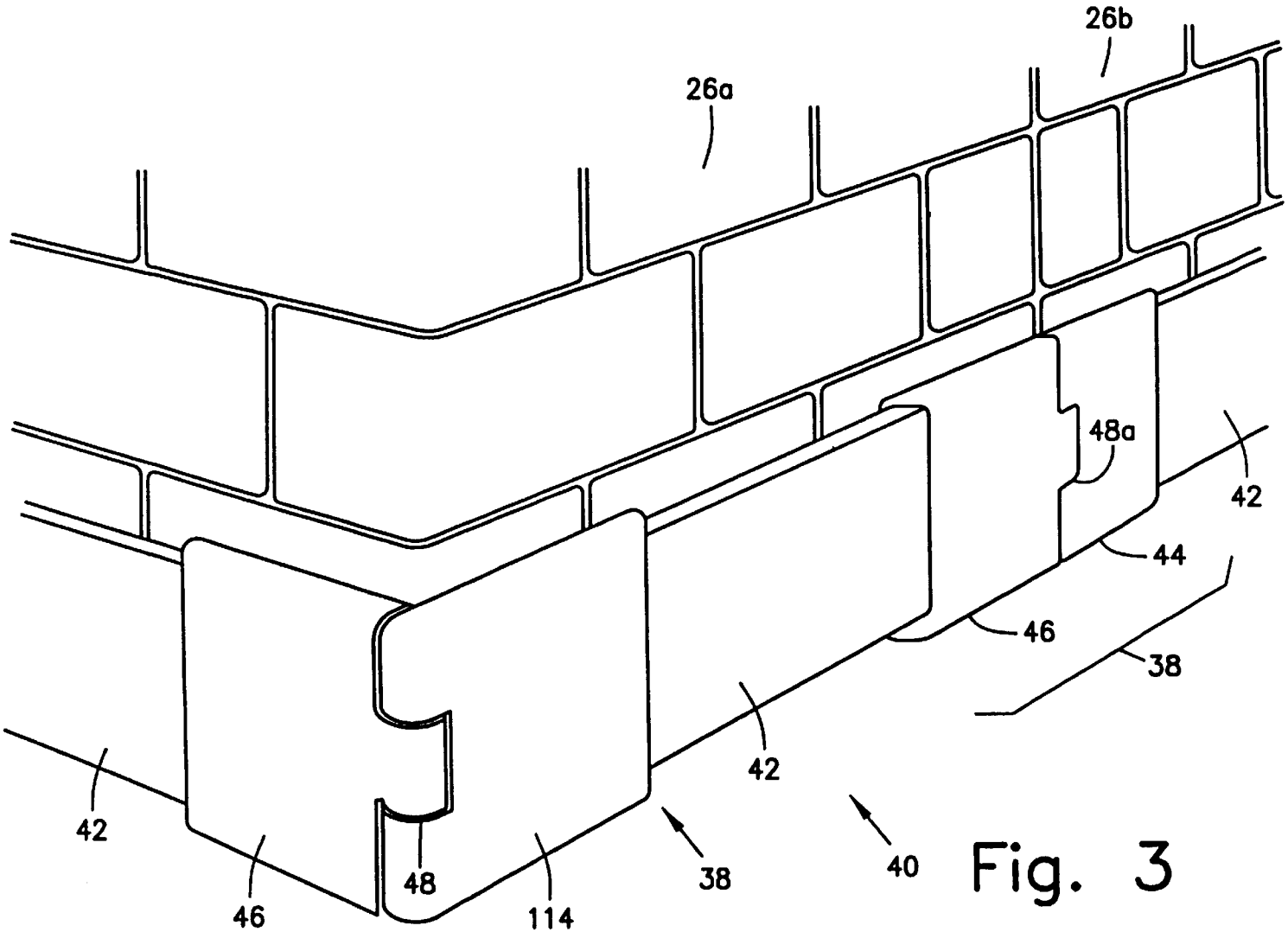
FIG. 3 is a perspective view of a pallet guard in accordance with a second embodiment of the invention when the pallet guard is used to protect multiple pallets.
Figure 4:
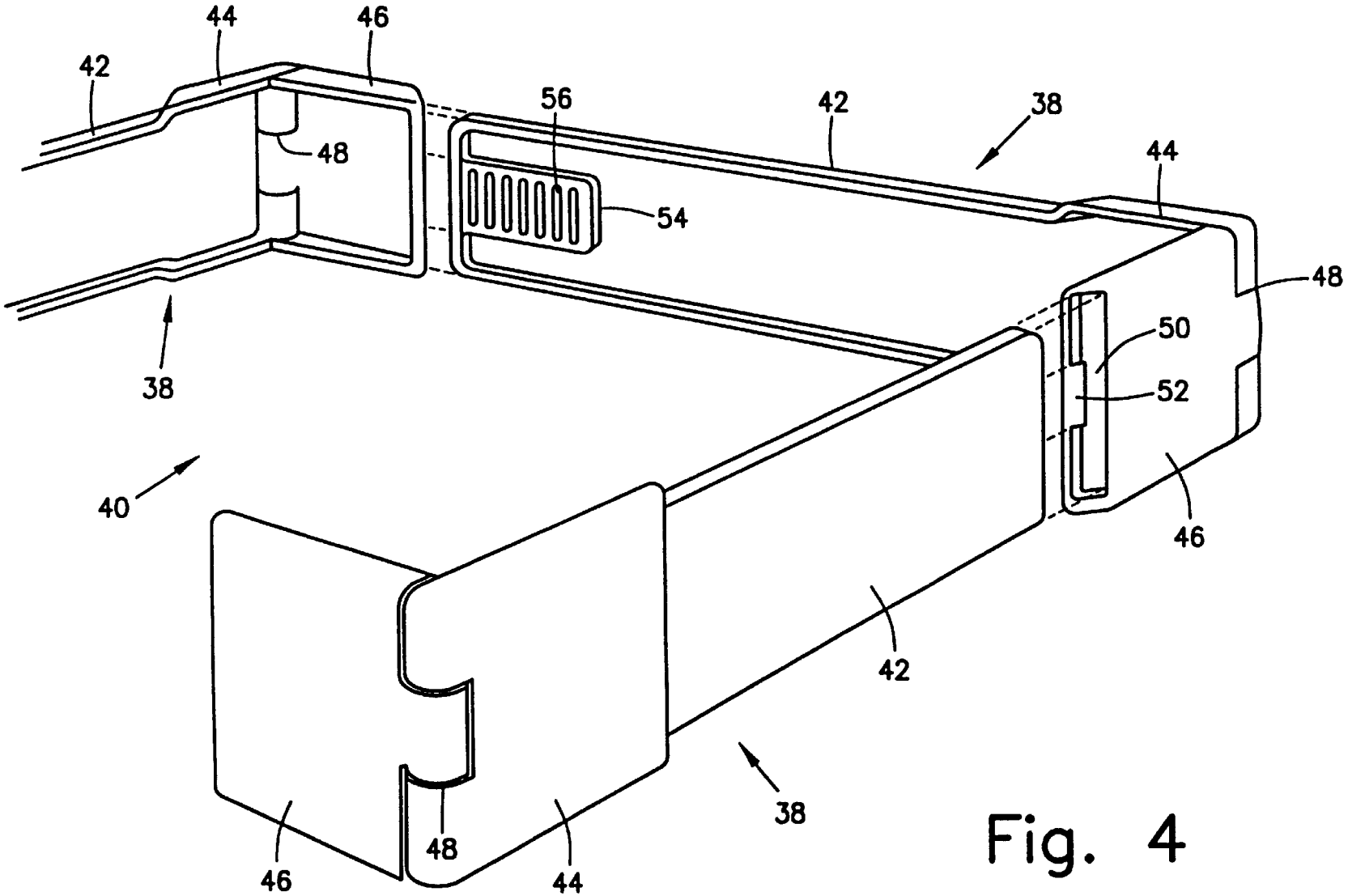
FIG. 4 is a perspective exploded view of a pallet guard in accordance with the second embodiment of the invention.
Figure 5:
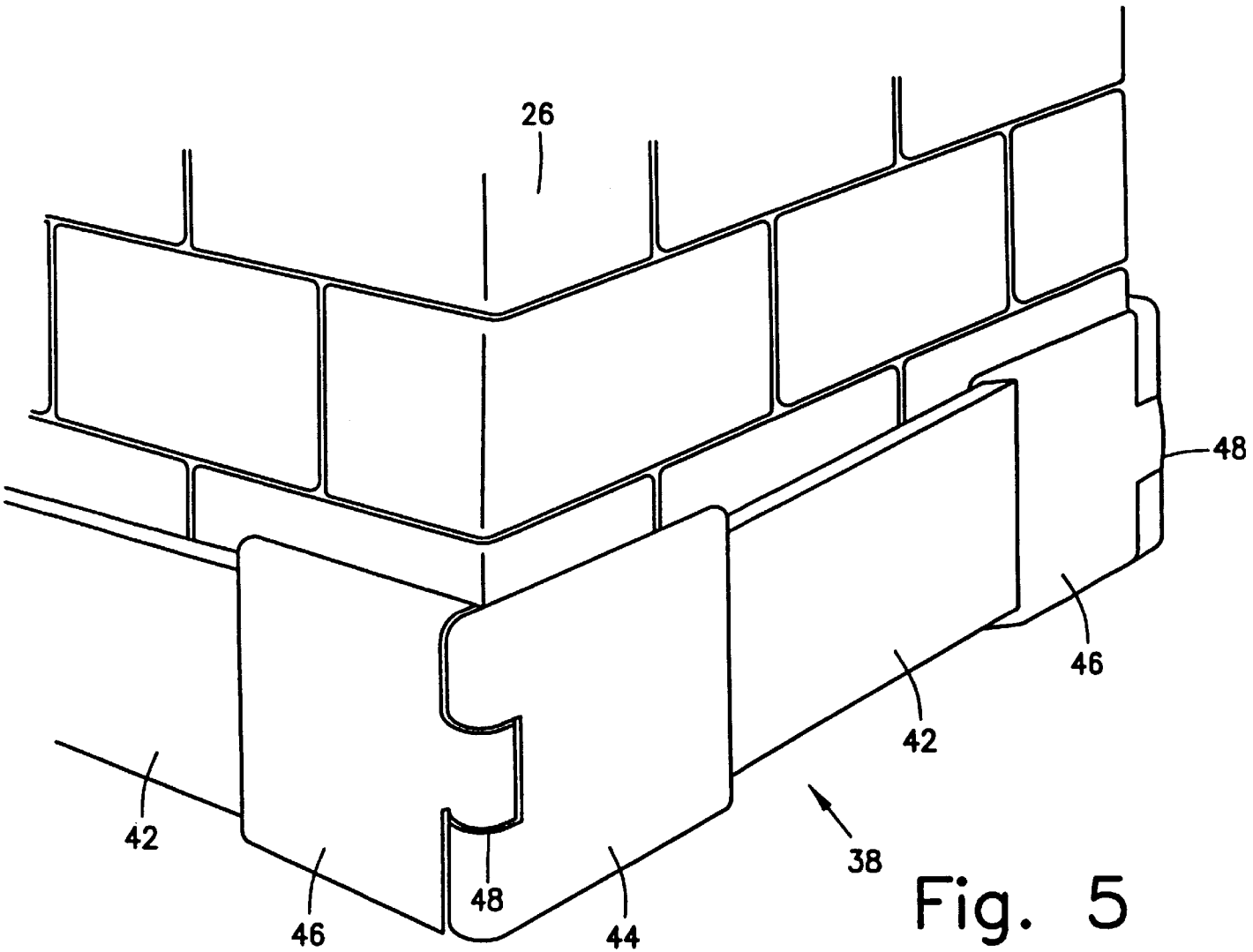
FIG. 5 is a perspective view of a pallet guard in accordance with the second embodiment of the invention when the pallet guard is used to protect a single pallet.

FIGS. 3–5 show a second embodiment of a pallet guard in accordance with the invention. The second embodiment provides for greater flexibility and modularization, for example, and eliminates the need for a straight or connecting piece when the pallet guard is to protect several pallets disposed adjacent to one another. This is accomplished through the use of pallet guard sections 38. As with the first embodiment, a plurality of substantially identical, modular, pallet guard sections 38 are coupled together to form a pallet guard 40.

Referring to FIG. 3, each pallet guard section 38 is comprised of a wall section 42 that is preferably integral with a first corner portion 44 of corner piece 48. First corner portion 44 is further hingedly coupled to a second corner portion 46 of corner piece 48. Corner piece 48 thus may assume an infinite number of positions between a substantially straight position where first and second corner portions 44, 46 are in line or straight with respect to one another, and a position where first corner portion 44 and second corner portion 46 form a corner of pallet guard 40. Each pallet guard section 38 is preferably molded in two parts and then may be permanently or removably joined at corner piece 48, allowing for a one piece design.

Referring to FIG. 4, four pallet guard sections 38 can be combined to form a pallet guard 40 to protect a single pallet (not shown). Pallet guard 40 is assembled in the same manner as pallet guard 20 and, as with the first embodiment, the area covered by pallet guard 40 is adjustable. Each second corner portion 46 of pallet guard 40 includes a cavity 50. Cavities 50 are designed to receive wall sections 42 of an adjacent pallet guard section 38. Disposed within cavities 50 are detent tabs 52 extending from a wall defining cavity 50, inwardly into a respective cavity 50. Each wall section 42 includes a recess tab 54 having a plurality of recesses 56 therein. When a wall section 42 of a first pallet guard section 38 is slidably received within a corresponding second corner portion 46 of a second pallet guard section 38, detent tab 52 of the second corner portion 46 mates with a selected recess 56 thereby retaining the wall section in a selected position within second corner portion. A plurality of recesses 56 are provided on recess arrangement 54 so that a side wall can be adjusted within a second corner portion and thereby define a plurality of lengths of a side of pallet guard 40. Disassembly of pallet guard 40 is the same as disassembly of pallet guard 20 and so the description will be omitted for the sake of clarity. Further, as in the first embodiment, tabs 52 and recess arrangements 54 can be omitted, allowing for limited continuous adjustability.

Pallet guard sections 38 thus can be combined to form a square barrier having a limited adjustment range! for example, as small as 40" square to as large as 58" square or can be formed as an oblong design according to the dimensions of an irregularly sized pallet.

In FIG. 4, a single pallet is shown protected by pallet guard 40 and so each second corner portion 46 is at an angle with respect to a respective first corner portion 44 so that corner pieces 48 are in the shape of corners. Alternatively, some of second corner portions 46 can be retained straight or in line with respect to a corresponding first corner portion 44 as is shown at corner 48*a* in FIG. 3. A pallet guard section 38 having a corner piece disposed like piece 48*a* can be used to increase the size of pallet guard 40 to protect a plurality of pallets. Since first and second corner portions 44, 46 are hingedly connected, a user has the option of maintaining a straight profile between these two elements thereby facilitating lengthening of pallet guard 40 to accommodate several pallets disposed side-by-side, grouped pallets, or pallets otherwise arranged in multiple clusters. As shown in FIG. 3, pallet guard 40 can be adapted to protect two pallets holding two sets of merchandise 26*a* and 26*b*.

Thus, in the second embodiment, a plurality of modular pallet guard sections 36 are combined together to form a single pallet guard 40. As many pallet guard sections 36 arc used as is necessary to form pallet guard 40. If the pallet guard is to protect a single pallet, four pallet guard sections 36, for example, can be used. Fewer pallet guard sections can be used to form a pallet guard—for example, one or two. To expand pallet guard 40 to protect more pallets, second corner portion 46 is rotated to be unbent with respect to first corner portion 44 as is shown by corner pieces 48*a* in FIG. 3.

Referring to FIGS. 6–10, there is shown a third embodiment of the invention. A pallet guard 60 is comprised of a plurality of substantially identical, modular pallet guard sections 62. Each pallet guard section 62 is comprised of a wall 64 that is preferably integral with a first corner portion 66 of corner piece 74. First corner portion 66 is coupled to a second corner portion 68, as is shown most clearly in FIGS. 7 and 8. Corner piece 74 can be configured into a discrete number of positions including a straight position where first and second corner portions 66, 68 are substantially in line with respect to one another and a position where first and second corner portions 66, 68 form a corner.

Figure 7:
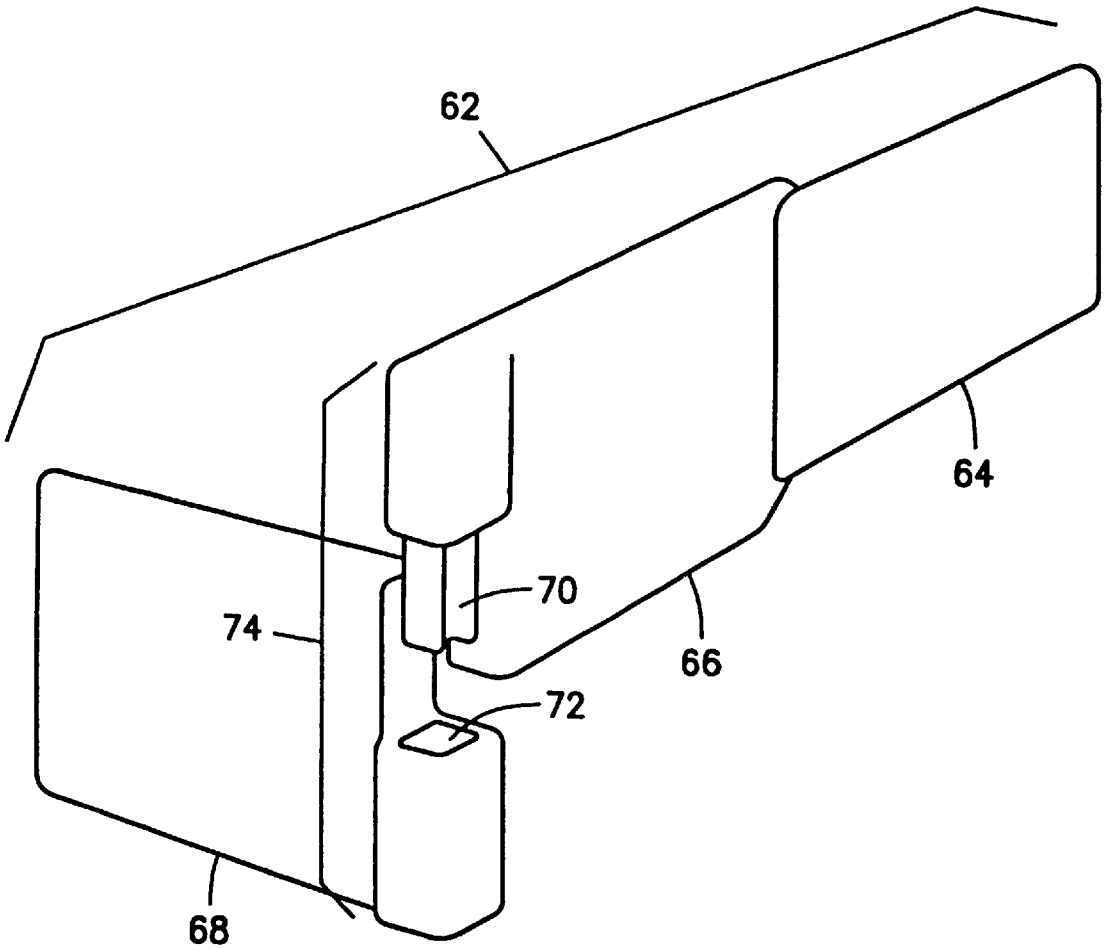
FIG. 7 is a perspective view detailing the assembly of a pallet guard section in accordance with the third embodiment.
Figure 8:
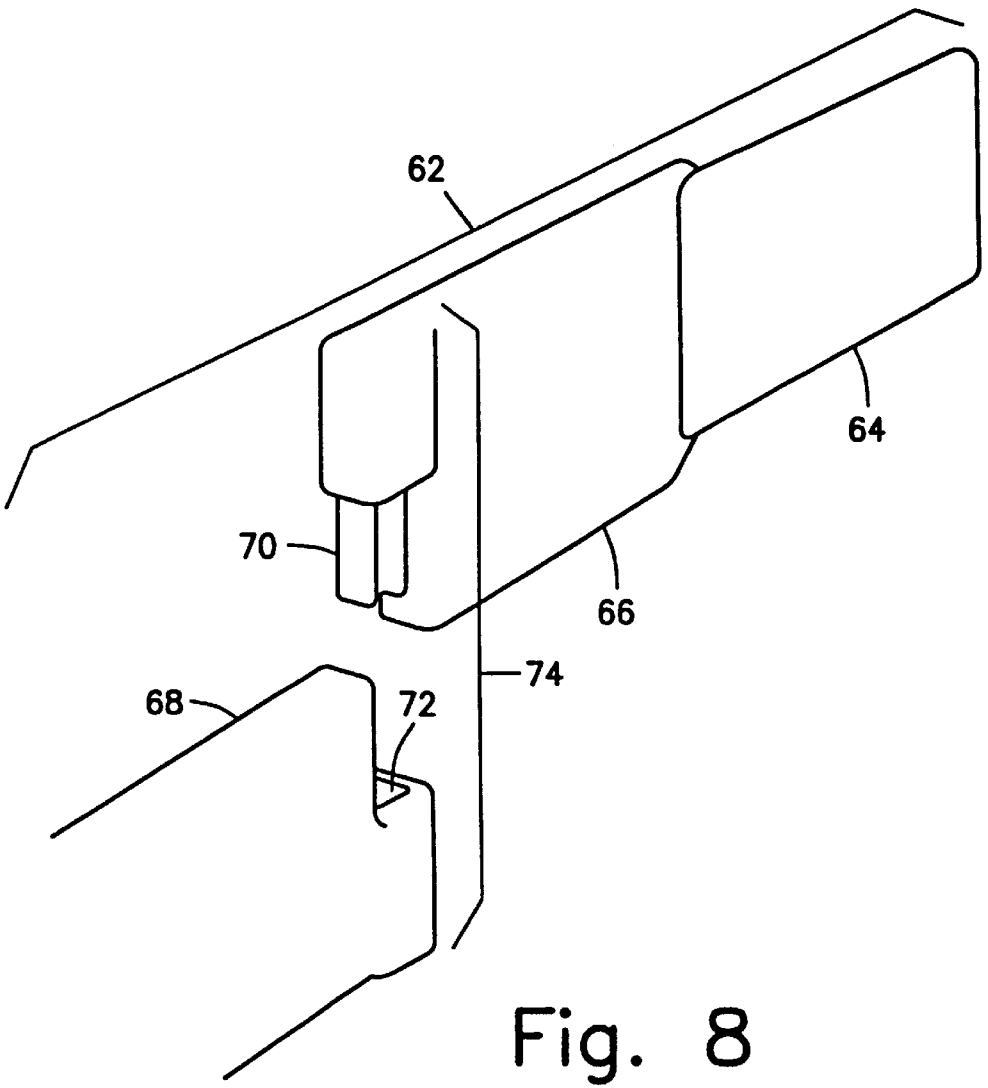
FIG. 8 is a perspective view detailing the assembly of a pallet guard section in accordance with the third embodiment.
Figure 9:
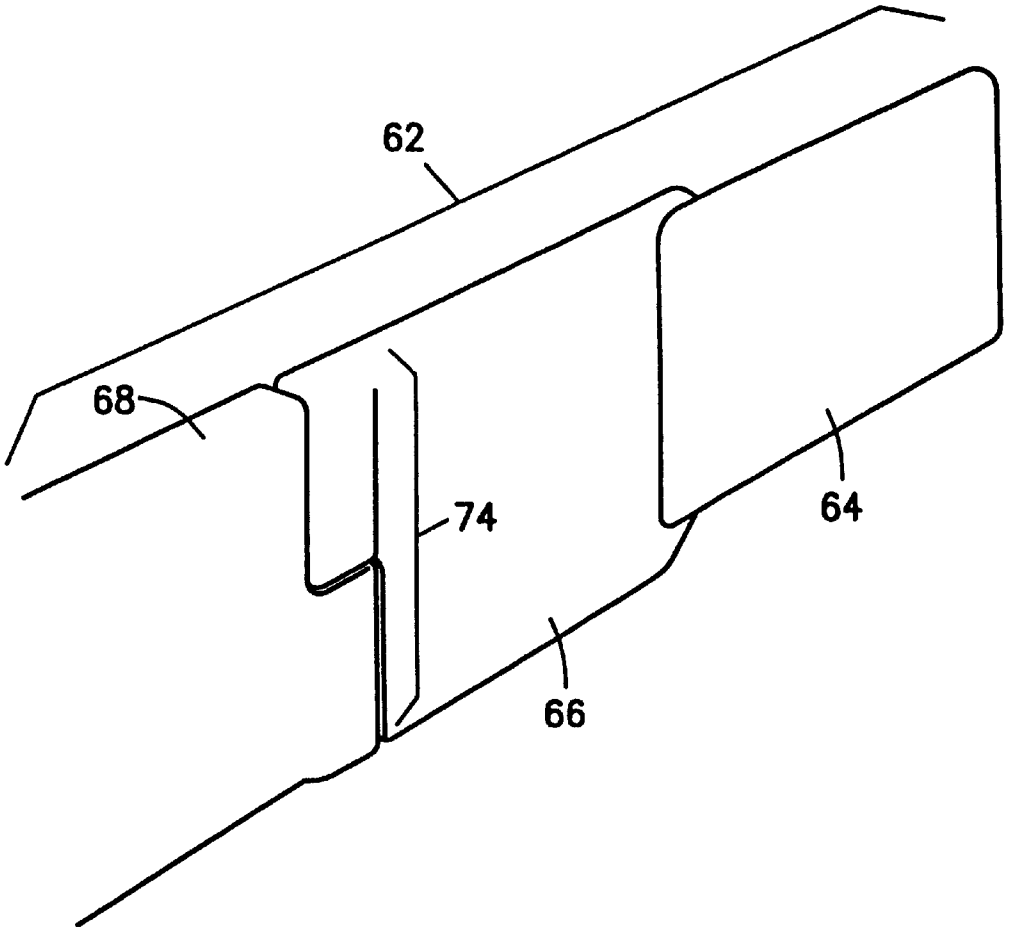
FIG. 9 is a perspective view showing an assembled pallet guard section in accordance with the third embodiment.

Referring to FIGS. 7 and 8, first corner portion 66 includes a post 70 that is shaped to slidably fit, preferably snugly, into a recess 72 of second corner portion 68. Clearly, the provision of the posts and recesses could be reversed so that second corner portion 68 includes the post and first corner portion 66 includes the recess. As can be seen in the figures, first and second corner portions 66, 68 can be oriented with respect to one another in one of three configurations. First and second corner portions 66, 68 can be in line with respect to each other as is shown in FIGS. 8 and 9 so that they form a 0° or 180° angle with respect to one another. Alternatively, first and second corner portions 66, 68 can be disposed perpendicularly to one another in either a 90° or 270° angle as is shown in FIG. 7, thus forming a corner.

Figure 6:
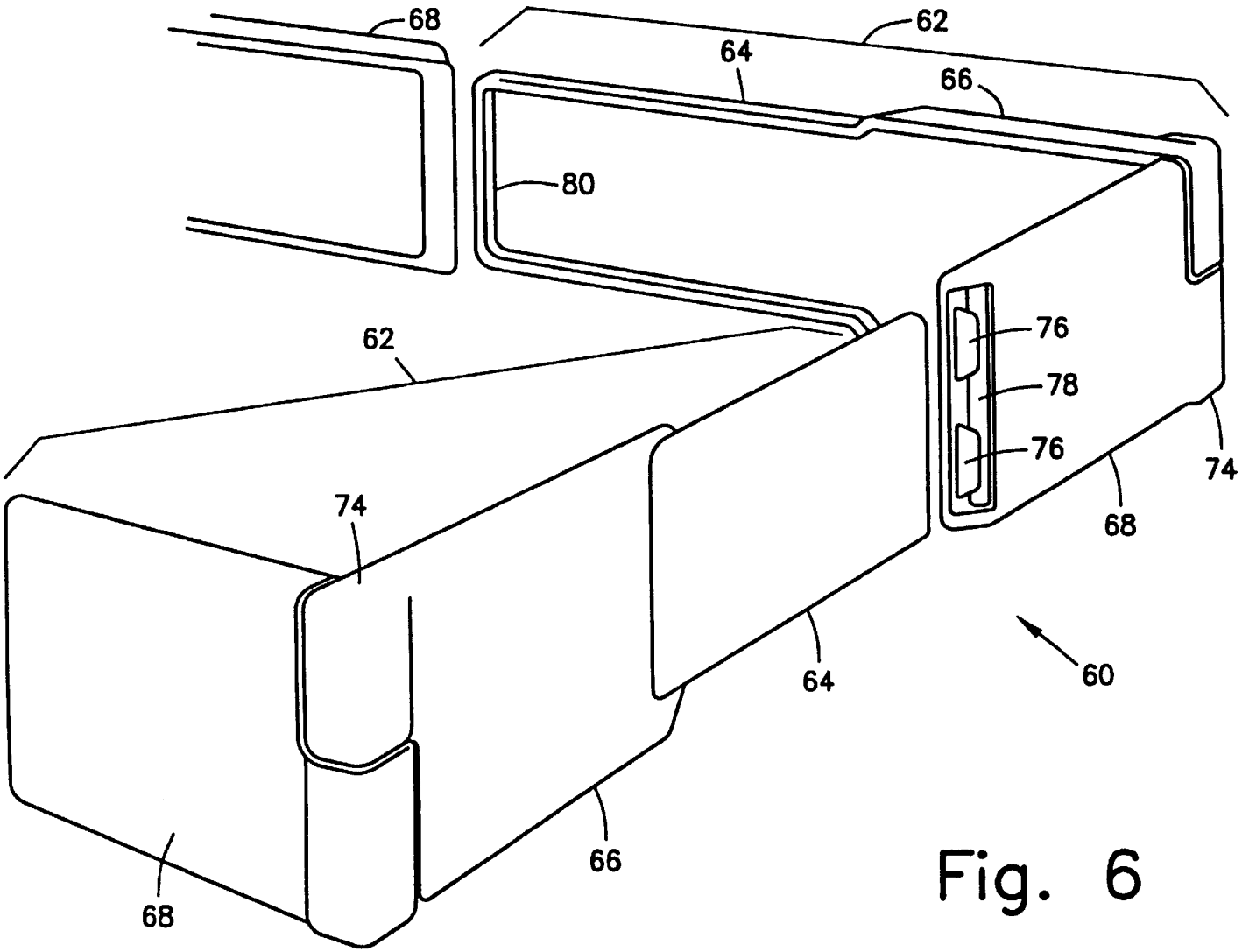
FIG. 6 is a perspective view of a third embodiment of a pallet guard in accordance with the invention.
Figure 10:
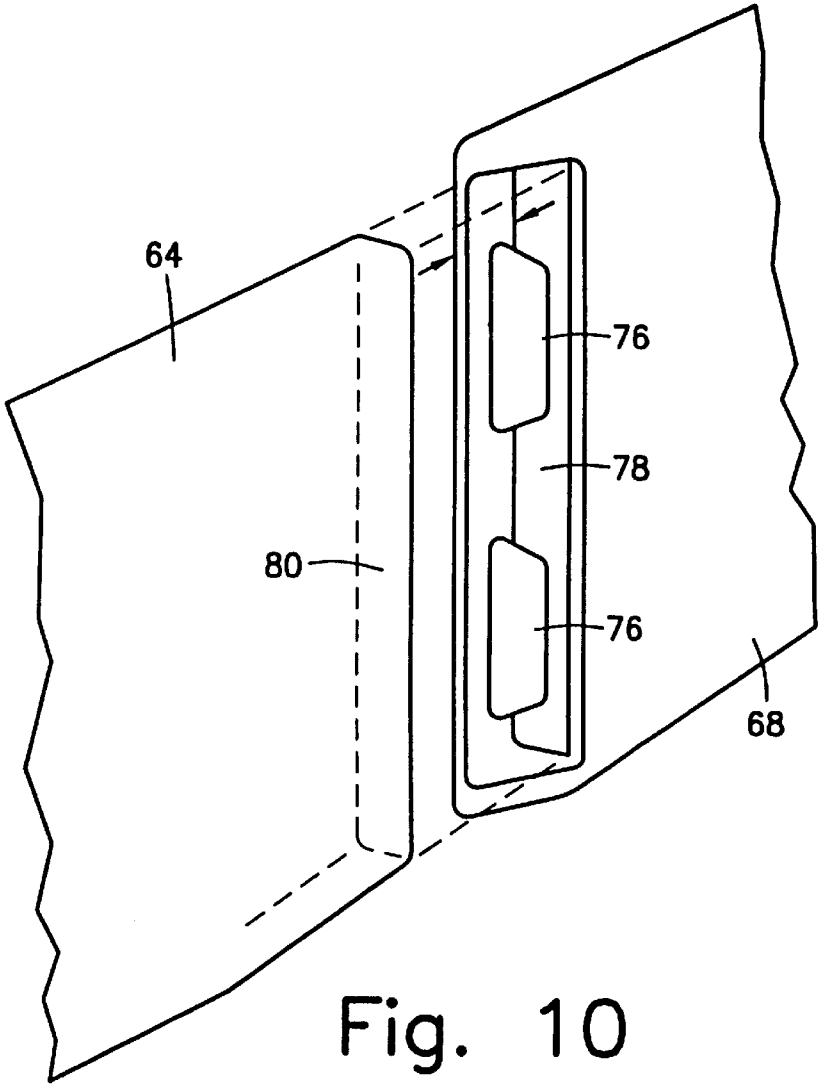
FIG. 10 is an enlarged perspective view showing detents of a corner piece of a pallet guard section in accordance with the third embodiment.

Referring to FIGS. 6 and 10, there is shown the structure used in combining pallet guard sections 62. Each second corner portion 68 includes a cavity 78 having a plurality of tabs 76 extending therein. Cavity 78 is effective to receive a wall section of an adjacent pallet guard section. As can be seen most clearly in FIG. 6, each wall section 64 includes a ridge 80 at a distal end thereof. When adjacent pallet guard sections are combined, the ridge 80 of a wall section 64 is pushed against a corresponding tab 76 of an adjacent pallet guard section. This pushing biases tab 76 toward a wall that defines cavity 78 to thereby allow wall portion 64 to be received inside of cavity 78 of second corner portion 68. Once ridge 80 passes tab 76 inside cavity 78, tab 76 resumes its original position thereby retaining wall portion 64 within cavity 78.

Cavity 78 is designed so that once wall portion 64 is received within cavity 78, wall portion 64 assumes a telescoping or sliding arrangement with respect to second corner portion 68. That is, wall portion 64, and so a side of the resulting pallet guard 60, can have a continuous range of perimeter lengths (thus defining an infinite number of areas for pallet guard 60). Pallet guard 60 thus allows for a continuous adjustment of positions, as opposed to a discrete number of positions as in the first two illustrated embodiments. Wall portion 64 is still retained within cavity 78 through a tab and recess as with the previous embodiment. It should be made clear, however, that a recess tab could be provided on wall section 64, as with the first two embodiments, thereby allowing for a discrete adjustment of positions as well.

Pallet guard 60, as with the previous embodiments, can be used to protect a single pallet or multiple pallets. If a single pallet is to be protected, first corner portion 66 and second corner portion 68 can be arranged perpendicular to one another as is shown in FIG. 7, so that corner piece 74 forms a corner. In such an arrangement, for example, four pallet guard sections 62 can be used—though it should be clear that fewer pallet guard sections can be used—for example one or two. If two pallets are to be protected, six pallet guard sections 62 can be used, for example, where two pallet guard sections have first and second corner portions 66, 68 unbent with respect to one another as is shown in the corner pieces in FIGS. 8 and 9.

Figure 11:
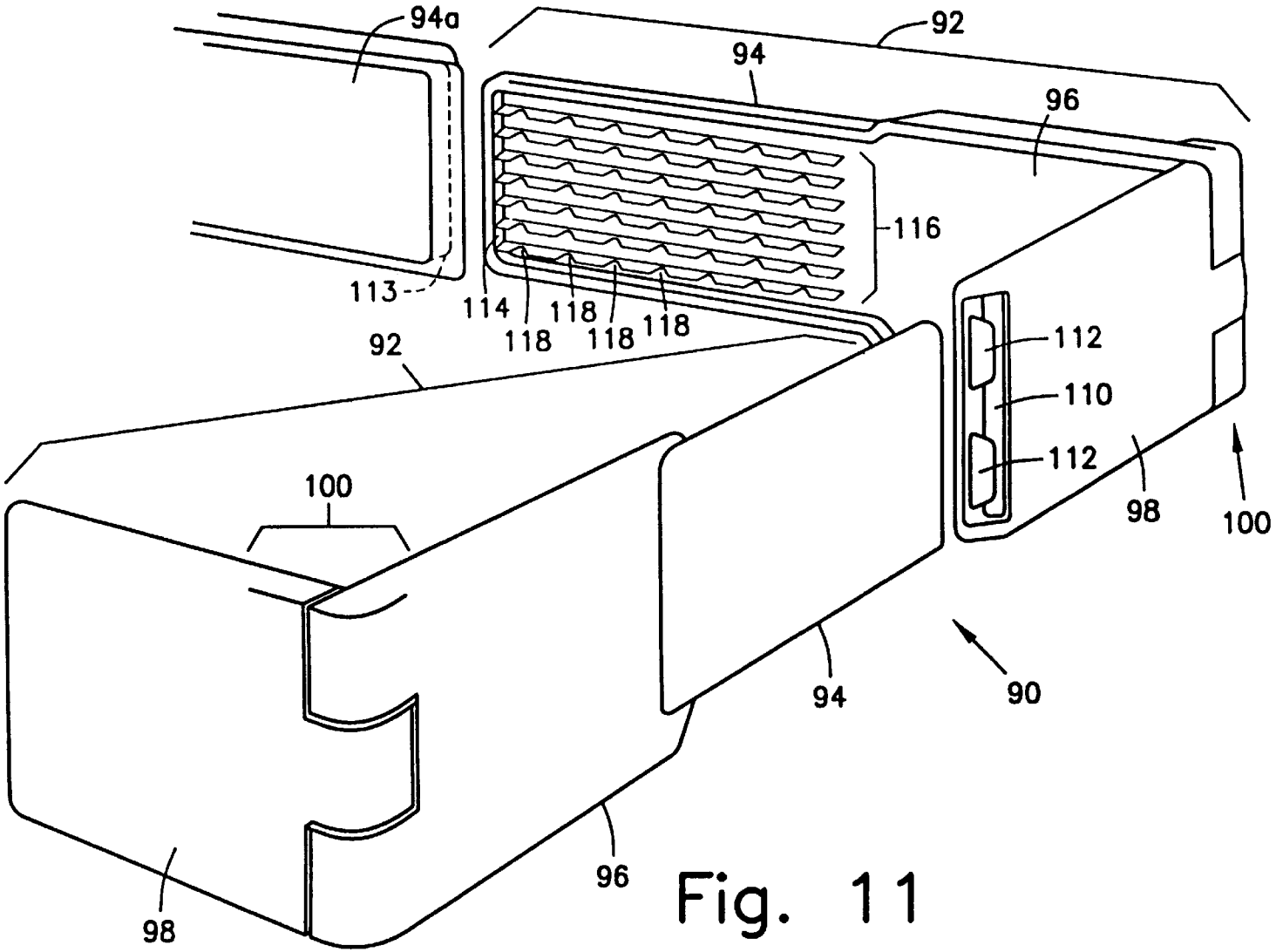
FIG. 11 is an elevated perspective view of a fourth embodiment of a pallet guard in accordance with the invention.

Referring to FIG. 11, there is shown a fourth embodiment of the invention. A pallet guard 90 in accordance with the fourth embodiment of the invention is comprised of a plurality of pallet guard sections 92. Each pallet guard section 92 includes a wall section 94 that is preferably integral with a first corner portion 96 of a corner piece 100. First corner portion 96 is coupled to a second corner portion 98 of a corner piece 100, as is most clearly shown in FIG. 12.

Figure 12:
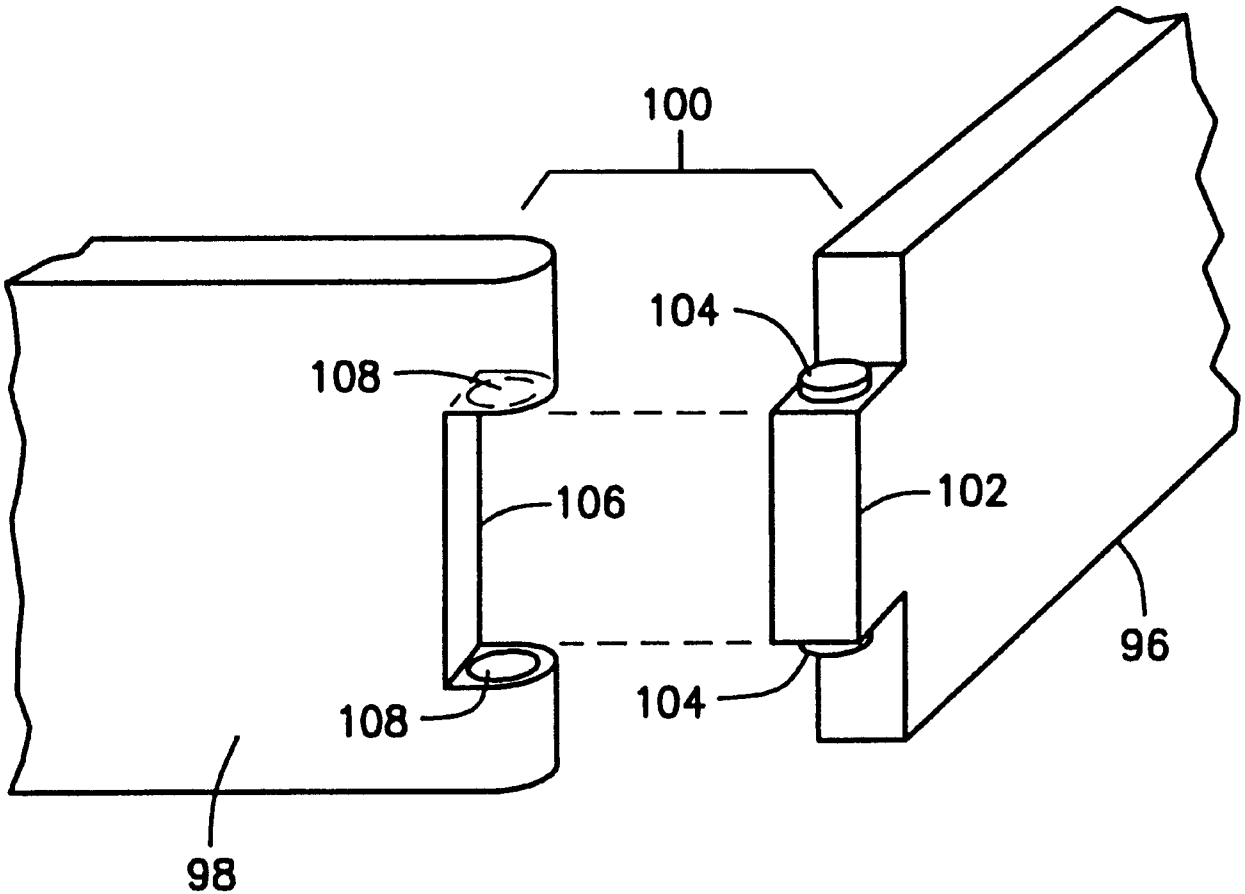
FIG. 12 is a perspective view detailing the assembly of a pallet guard section in accordance with the fourth embodiment.

Referring to FIG. 12, first corner portion 96 includes two buttons 104 extending perpendicularly from a reduced height portion 102. Buttons 104 can be substantially cylindrical with a tapered end surface to facilitate insertion into corresponding holes 108 of portion 98. Second corner portion 98 includes a recess 106 having two button holes 108 which receive buttons 104 with a snug fit. First and second corner portions 96, 98 can be combined in line with respect to each other so that they form a 0° or 180° angle. Alternatively, first and second corner portions 96, 98 can be disposed perpendicularly to one another in either a 90° or 270° angle. Corner pieces 100, made of first and second corner portions 96, 98, thus are movable among a discrete plurality of positions and thus suitable to be used with an individual pallet or a plurality of adjacent pallets.

Referring to FIG. 11, there is shown the structure for combining pallet guard sections 92. Each second corner portion 98 includes a cavity 110 having one or a plurality of tabs 112 extending therein. Cavity 110 is effective to receive a wall section of an adjacent pallet guard section. Each wall section 94 includes a ridge 114 at a distal end thereof. Wall sections 94 further preferably include a plurality of discontinuous rails 116 each having a plurality of reduced height portions or voids 118. When adjacent pallet guard sections 92 are combined, a ridge 114 of a wall section 94 of a first pallet guard section 92 is pushed against a corresponding tab 112 of an adjacent pallet guard section 92. This pushing biases tab 112 toward a wall defining cavity 110 to thereby allow wall portion 94 to be received inside of cavity 110 of second corner portion 98. Once ridge 114 passes tab 112 inside cavity 110, tab 112 resumes its original position thereby retaining wall portion 94 within cavity 110.

Cavity 110 is designed so that once wall portion 94 is received within cavity 110, wall portion 94 assumes a telescoping or sliding arrangement with respect to second corner portion 98. Unlike the previous illustrated embodiment, pallet guard 90 allows for discrete positioning of wall portion 94 within cavity 110. At a discrete plurality of positions of wall portion 94, tabs 112 will engage with voids 118 of rails 116. Thus, each wall portion 94 can assume a discrete plurality of lengths and so pallet guard 90 is adjustable to varying sized pallets.

Alternatively, instead of tabs 112 engaging in reduced height portions 118 of rails 116 to provide detents, a vertically extending strip 113 (shown in phantom) can be provided on a corner surface 94*a* which allows wall portion 94 to slide between strip 113 and corner surface 94*a* of wall portion 94. This allows for detenting of strip 113 in reduced height portions 118. Of course, as in the third embodiment, it is clear that the detents and recesses can be dispensed with, in which case, limited continuous adjustability is provided.

Pallet guard 90, as with the previous embodiments, can be used to protect a single pallet or multiple pallets. If a single pallet is to be protected, first corner portions 96 and second corner portions 98 can be arranged perpendicular to one another as is shown in FIG. 12, so that corner pieces 100 form corners. In such an arrangement, for example, four pallet guard sections 92 can be used—though fewer pallet guard sections could be used, for example one or two. If two pallets are to be protected, six pallet guard sections 9, for example, can be used where two pallet guard sections have first and second corner portions 96, 98 in line with respect to one another. Corner piece 100, made of corner portions 96, 98, thus is movable among a discrete plurality of positions.

In the embodiments shown above, all of the pallet guard section modules are interlocking and interchangeable and can even be interchanged between different embodiments. The corresponding pallet guards do not require tools to assemble or disassemble. The components of the pallet guards can be formed from any suitable material, but preferably are formed from a molded plastic such as polypropylene, polystyrene, polyethylene or any other suitable plastic.

Although each wall portion is shown to be inserted into a void of a corresponding corner portion, it is evident that each corner portion could be inserted into a corresponding void in a wall portion. Thus, each wall portion can be viewed as either an insertion member or a receiving member. Similarly, each corner portion can be viewed as either a corresponding receiving member or an insertion member.

Although all of the wall portions are shown as being straight and unbent, clearly the wall portions can be bent or even curved without departing from the scope or spirit of the invention.

Thus by providing modular pallet guard sections, a pallet guard can be created of a desired size to accommodate and protect multiple pallets. By combining pallet guard sections using telescoping sections, the length of each wall of the pallet guard, and the corresponding area or footprint of the pallet guard, can be adjusted for irregular shaped pallets or for pallets having merchandise extending beyond the footprint of the pallet.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A pallet guard for a pallet, the pallet guard including a plurality of pallet guard sections, the pallet guard sections being assembleable into the pallet guard and the assembled pallet guard comprising:

at least one insertion member; and at least one receiving member coupled to said insertion member; wherein one of said insertion member and said receiving member provides a plurality of adjustable positions for said insertion member with respect to said receiving member so as to allow a combined length of the insertion member and receiving member to be adjusted to a dimension of the pallet and any merchandise thereon whereby a respective insertion member and a respective receiving member are engageable in a plurality of positions thereby defining a plurality of areas for said pallet guard.

2. The pallet guard as claimed in claim 1, wherein one of said insertion member and said receiving member is a wall portion and the other of said insertion member and said receiving member is a connecting piece.

3. The pallet guard as claimed in claim 2, wherein one of said wall portion and said connecting piece includes a detent and the other of said wall portion and said connecting piece includes a plurality of recesses, each recess being effective to receive said detent.

4. The pallet guard as claimed in claim 3, wherein said wall portion includes said plurality of recesses.

5. The pallet guard as claimed in claim 2, wherein said wall portion is substantially straight.

6. The pallet guard as claimed in claim 2, wherein said connecting piece comprises:

a first corner portion; and a second corner portion hingedly coupled to said first corner portion; wherein said first and second corner portions are moveable among a plurality of positions with respect to one another including a substantially straight position where said first and second corner portions are substantially in line with respect to one another, and a position in which the two portions are disposed at an angle to one another.

7. The pallet guard as claimed in claim 6, wherein one of said wall portion and said connecting piece includes a detent and the other of said wall portion and said connecting piece includes a plurality of recesses, each recess being effective to receive said detent.

8. The pallet guard as claimed in claim 7, wherein said wall portion includes said plurality of recesses.

9. The pallet guard as claimed in claim 2, wherein said connecting piece comprises:

a first corner portion; and a second corner portion coupled to said first corner portion; wherein said first and second corner portions are moveable among a discrete set of positions with respect to one another including a substantially straight position where said first and second corner portions are substantially in line with respect to one another, and a position in which the two portions are disposed at an angle to one another.

10. The pallet guard as claimed in claim 9, wherein one of said wall portion and said connecting piece includes a detent and the other of said wall portion and said connecting piece includes a plurality of recesses, each recess being effective to receive said detent.

11. The pallet guard as claimed in claim 10, wherein said wall portion includes said plurality of recesses.

12. The pallet guard as claimed in claim 11, wherein:

said first corner portion includes a post; and said second corner portion includes a recess which receives said post.

13. The pallet guard as claimed in claim 11, wherein:

said first corner portion includes at least one button; and said second corner portion includes at least one button hole, said button hole receiving and mating with said button.

14. The pallet guard as claimed in claim 2, wherein one of said wall portion and said connecting piece includes at least one detent and the other of said wall portion and said connecting piece includes at least one rail, each rail having plurality of recesses, said recesses each effective to receive said detent so that a corresponding connecting piece and a corresponding wall portion are adjustable with respect to one another in a discrete plurality of positions.

15. The pallet guard as claimed in claim 9, wherein one of said wall portion and said connecting piece includes at least one detent and the other of said wall portion and said connecting piece includes at least one rail, each rail having a plurality of recesses, said recesses each effective to receive said detent so that a corresponding connecting piece and a corresponding wall portion are adjustable with respect to one another in a discrete plurality of positions.

16. The pallet guard as claimed in claim 1, wherein the insertion member is slidable in said receiving member, thus providing said plurality of positions.

17. The pallet guard as claimed in claim 16, wherein the plurality of positions are continuously adjustable over a limited range of adjustment.

18. The pallet guard as claimed in claim 16, wherein the plurality of positions are discretely adjustable over a limited range of adjustment.

19. The pallet guard as claimed in claim 16, wherein each of said pallet guard sections is modular thus allowing the pallet guard sections to be combined together to protect a plurality of adjacently arranged pallets.

20. A method of assembling a pallet guard for a pallet, the pallet and any material thereon defining a length and a width determining a pallet size, said method comprising the acts of:

coupling together a plurality of pallet guard sections to form an assembled pallet guard, the assembled pallet guard comprising at least one insertion member and at least one receiving member coupled to said insertion member; wherein at least one of said insertion member and said receiving member provides a plurality of adjustable positions for said insertion member with respect to said receiving member so as to allow a combined length of the insertion member and receiving member to be adjusted to a dimension of the pallet whereby a respective insertion member and a respective receiving member are engageable in a plurality of positions thereby defining a plurality of areas for said pallet guard; and adjusting the size of said pallet guard to the pallet size.

21. The method as claimed in claim 20, wherein:

said act of adjusting includes moving said insertion member with respect to said receiving member to one of the plurality of positions.

22. A pallet guard for a pallet, the pallet and any material thereon defining a length and a width determining a pallet size, the pallet guard including a plurality of pallet guard sections, the pallet guard sections being assembleable into an assembled pallet guard, the assembled pallet guard comprising:

at least one wall portion; and at least one connecting piece, said connecting piece including a first corner portion coupled to a second corner portion; where said first and second corner portions are movable among a plurality of positions with respect to one another including a straight position where said first and second corner portions are substantially in line with respect to each other, and a position in which the two corner portions are disposed at an angle to one another, and further wherein the at least one wall portion and at least one of the first and second corner portions have an overall length, the overall length being adjustable in a straight line to the pallet size.

23. The pallet guard as claimed in claim 22, wherein said first and second corner portions are hingedly coupled to one another.

24. The pallet guard as claimed in claim 22, wherein:

said first corner portion includes a post; and said second corner portion includes a recess which is effective to receive said post.

25. The pallet guard as claimed in claim 22, wherein:

said first corner portion includes at least one projection; and said second corner portion includes at least one hole which is effective to receive and mate with said projection.

26. A pallet guard for a pallet, the pallet with any material thereon defining a length and a width and determining a pallet size, the pallet guard comprising:

a plurality of modular wall sections, the plurality of wall sections beings coupleable together by connecting members, the wall sections having a height sufficient to guard at least edge portions of a pallet, the wall sections being coupleable together by the connecting members so that one pallet or a plurality of adjacent pallets can be protected by said pallet guard, a combination of a wall section and a connecting member having an overall length, the overall length being adjustable in a straight line to the pallet size.

27. The pallet guard of claim 29, wherein the pallet has a pallet height and the height of the wall section is sufficient to guard the entire pallet height.

28. The pallet guard of claim 26, wherein the wall sections are adjustable so as to account for merchandise on the pallet extending beyond an area defined by the pallet.

29. The pallet guard of claim 27, wherein the height of the pallet guard is greater than the pallet height.

30. The pallet guard of claim 26, wherein the pallet has a pallet height and the height of the pallet guard is less than the height of the pallet.

31. A pallet guard for a pallet or merchandise to be displayed, the pallet guard comprising:

a plurality of modular wall sections, the plurality of wall sections being coupleable together by connecting members so as to surround the sides of the pallet or the merchandise to be displayed, the wall sections having a height sufficient to guard at least edge portions of a pallet or portions of the merchandise to be displayed, the wall sections being releasably coupleable together by the connecting members, the connecting members allowing the wall sections to be releasably coupled in either a perpendicular relationship or in an aligned relationship to allow the modular wall sections to protect one or more pallets or one or more groups of merchandise to be displayed, wherein a first quantity of said modular wall sections protects a single pallet or group of merchandise and a second quantity of said modular wall sections protects multiple pallets or multiple groups of merchandise, a combination of a wall section and a connecting member having an overall length, the overall length being adjustable in a straight line to the pallet size.

32. A guard device for guarding material, the guard device including a plurality of guard sections, the guard sections being assembleable into the guard device and the assembled guard device comprising:

at least one insertion member; and at least one receiving member coupled to said insertion member; wherein one of said insertion member and said receiving member provides a plurality of adjustable positions for said insertion member with respect to said receiving member so as to allow a combined length of the insertion member and receiving member to be adjusted to a dimension of the material whereby a respective insertion member and a respective receiving member are engageable in a plurality of positions thereby defining a plurality of areas for said guard device.

33. A method of assembling a guard device for guarding material, the material defining a length and a width determining a material size, said method comprising the acts of:

coupling together a plurality of guard sections to form an assembled guard device, the assembled guard device comprising at least one insertion member and at least one receiving member coupled to said insertion member; wherein at least one of said insertion member and said receiving member provides a plurality of adjustable positions for said insertion member with respect to said receiving member so as to allow a combined length of the insertion member and receiving member to be adjusted to a dimension of the material whereby a respective insertion member and a respective receiving member are engageable in a plurality of positions thereby defining a plurality of areas for said guard device; and adjusting the size of said guard device to the material size.

34. A guard device for material, the material defining a length and a width determining the material size, the guard device including a plurality of guard sections, the guard sections being assembleable into an assembled guard device, guard device comprising:

at least one wall portion; and at least one connecting piece, said connecting piece including a first corner portion coupled to a second corner portion; where said first and second corner portions are movable among a plurality of positions with respect to one another including a straight position where said first and second corner portions are substantially in line with respect to each other, and a position in which the two corner portions are disposed at an angle to one another, and further wherein the at least one wall portion and at least one of the first and second corner portions have an overall length, the overall length being adjustable in a straight line to the material size.

35. A guard device for material, the material defining a length and a width and determining a material size, the guard device comprising:

a plurality of modular wall sections, the plurality of wall sections being coupleable by connecting members, the wall sections having a height sufficient to guard at least edge portions of the material, the wall sections being coupleable together by the connecting members so that one unit of material or a plurality of adjacent units of material can be protected by said guard device, a combination of a wall section and a connecting member having an overall length, the overall length being adjustable in a straight line to the material size.

* * * * *